US010625404B2

(12) United States Patent
Chu

(10) Patent No.: US 10,625,404 B2
(45) Date of Patent: Apr. 21, 2020

(54) SOCKET STRUCTURE

(71) Applicant: GUOCHANG COLD FORGING CO., LTD., Taichung (TW)

(72) Inventor: Ting-Wei Chu, Taichung (TW)

(73) Assignee: KUOCHANG COLD FORGING CO., LTD., Taichung (TW)

( * ) Notice: Subject to any disclaimer, the term of this patent is extended or adjusted under 35 U.S.C. 154(b) by 188 days.

(21) Appl. No.: 15/970,895

(22) Filed: May 4, 2018

(65) Prior Publication Data

US 2019/0061120 A1 Feb. 28, 2019

(30) Foreign Application Priority Data

Aug. 25, 2017 (TW) ..... 106212583 U

(51) Int. Cl.

*B25B 23/00* (2006.01)
*B25B 15/00* (2006.01)
*B25B 13/06* (2006.01)

(52) U.S. Cl.

CPC ..... *B25B 23/0035* (2013.01); *B25B 13/06* (2013.01); *B25B 15/004* (2013.01); *B25B 15/008* (2013.01)

(58) Field of Classification Search

CPC . B25B 23/0035; B25B 15/004; B25B 15/008; B25B 15/00; B25B 13/06

See application file for complete search history.

(56) References Cited

U.S. PATENT DOCUMENTS 5,520,075 A * 5/1996 Barmore ..... B25B 13/06 81/437
5,592,861 A * 1/1997 Barmore ..... B25B 13/06 81/124.6
9,452,516 B2 * 9/2016 Alavi ..... B25B 23/108

* cited by examiner

*Primary Examiner* — David B. Thomas

(57) ABSTRACT

A socket structure contains: a hollow body, a fitting member, an operation bar, a first spring, and a second spring. The hollow body includes a first accommodation groove, a connection groove, a first guide groove, and a second guide groove. The fitting member includes a first section, a second section, a second accommodation groove, a polygonal hole, and a peripheral trough. The hollow body further includes at least one fixing element, the first spring abuts against a stepped connection portion of the first guide groove and the second guide groove and the second section of the fitting member. The operation bar includes a polygonal extension and a peripheral rib. The second spring abuts against a bottom of the second guide groove, and a second end of the second spring pushes the polygonal extension of the operation bar to extend out of the second accommodation groove.

4 Claims, 5 Drawing Sheets

SOCKET STRUCTURE

FIELD OF THE INVENTION

The present invention relates to a socket structure corresponds to a variety of screws and nuts by way of the first accommodation groove and the second accommodation groove, and the operation bar is used as Allen wrench.

BACKGROUND OF THE INVENTION

A screw bolt and a nut are connected or removed by a socket or a socket tool so to as to be applicable for building construction, car repair and maintenance, or furniture assembly.

The socket is employed to lock or unlock tetragonal, hexagonal, and octagonal screw bolt. To lock or unlock screw bolt of specific shapes (such as gear, ratchet or star shape), a specific tool corresponding the screw bolt of the gear, ratchet or star shape is required, thus limiting using ranges.

The present invention has arisen to mitigate and/or obviate the afore-described disadvantages.

SUMMARY OF THE INVENTION

The primary aspect of the present invention is to provide a socket structure corresponds to a variety of screws and nuts by way of the first accommodation groove and the second accommodation groove, and the operation bar is used as Allen wrench.

To obtain the above mentioned aspect, a socket structure by the present invention contains: a hollow body, a fitting member, an operation bar, a first spring, and a second spring.

The hollow body includes a first accommodation groove defined on a first end thereof and configured to accommodate a polygonal driven element, a connection groove formed on a second end of the hollow body and configured to connect with a wrench, a first guide groove defined in the hollow body adjacent to the first accommodation groove, and a second guide groove defined between and communicating with the connection groove and the first guide groove, wherein a diameter of the first guide groove is more than the second guide groove.

The fitting member is movably housed in the first accommodation groove and the first guide groove, the fitting member includes a first section, an outer diameter of which corresponds to the first accommodation groove, and the fitting member includes a second section fitting with the first guide groove, wherein a length of the first section is less than a depth of the first accommodation groove.

The fitting member includes a second accommodation groove formed on the first section, and a diameter of the fitting member is less than the first accommodation groove, the fitting member includes a polygonal hole formed on the second section thereof and communicating with the second accommodation groove, and a peripheral trough formed on an outer wall of the second section, the hollow body further includes at least one fixing element inserted through the first guide groove so as to be fixed in the peripheral trough and to limit a maximum sliding distance of the fitting member.

The first spring is accommodated in the first guide groove, a first end of the first spring abuts against a stepped connection portion of the first guide groove and the second guide groove, and a second end of the first spring is biased against the second section of the fitting member so that the first section flushes with an opening of the first accommodation groove.

The operation bar includes a polygonal extension corresponding to the polygonal hole, a peripheral rib configured to abut against the second section so as to limit a maximum moving distance of the operation bar.

A first end of the second spring abuts against a bottom of the second guide groove, and a second end of the second spring pushes the polygonal extension of the operation bar to extend out of the second accommodation groove.

DETAILED DESCRIPTION OF THE PREFERRED EMBODIMENTS

Figure 1:
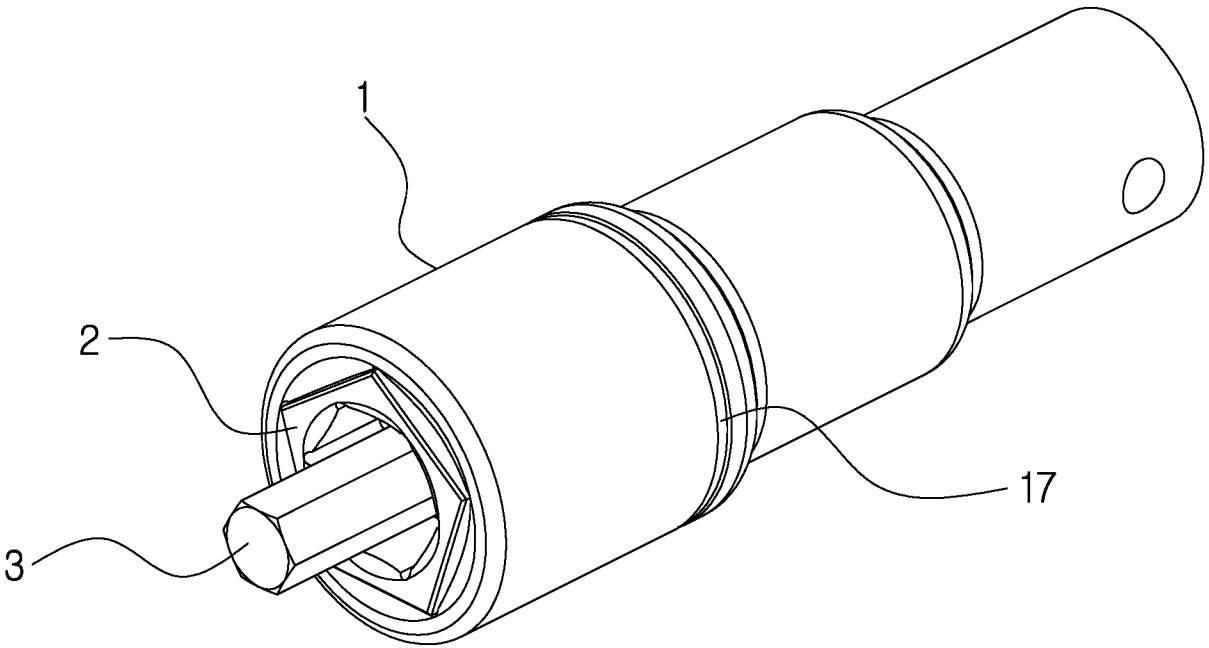
FIG. 1 is a perspective view showing the assembly of a socket according to a preferred embodiment of the present invention.
Figure 2:
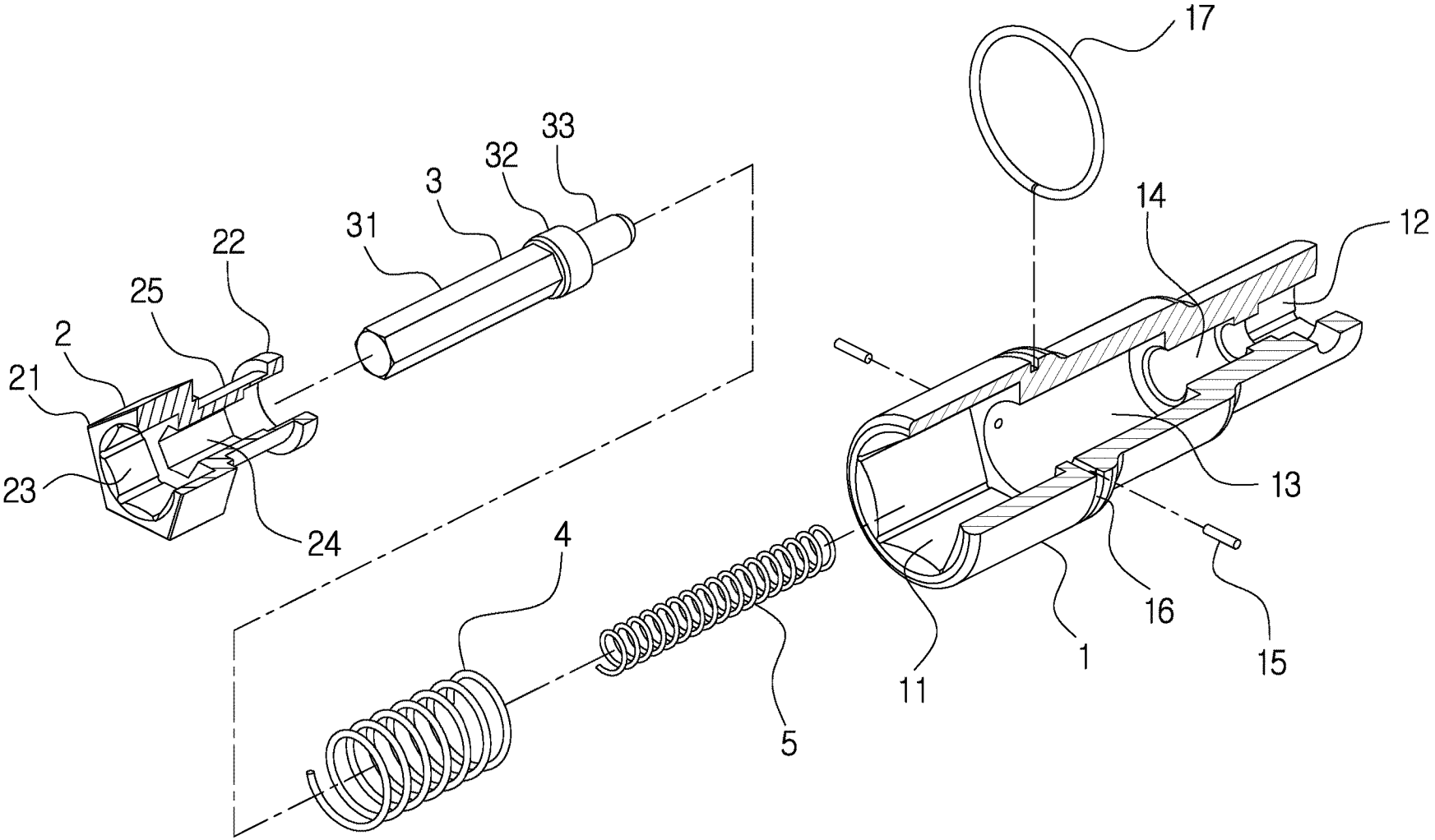
FIG. 2 is a cross-sectional perspective view showing the exploded components of the socket structure according to the preferred embodiment of the present invention.

The present invention will be clearer from the following description when viewed together with the accompanying drawings, which show, for purpose of illustrations only, a preferred embodiment in accordance with the present invention.

With reference to FIGS. 1-5, a socket structure in accordance with a preferred embodiment of the present invention comprises: a hollow body 1, a fitting member 2, an operation bar 3, a first spring 4, and a second spring 5.

The hollow body 1 includes a first accommodation groove 11 defined on a first end thereof and configured to accommodate a polygonal driven element, a connection groove 12 formed on a second end of the hollow body 1 and configured to connect with a wrench, a first guide groove 13 defined in the hollow body 1 adjacent to the first accommodation groove 11, and a second guide groove 14 defined between and communicating with the connection groove 12 and the first guide groove 13, wherein a diameter of the first guide groove 13 is more than the second guide groove 14.

The fitting member 2 is movably housed in the first accommodation groove 11 and the first guide groove 13. The fitting member 2 includes a first section 21, an outer diameter of which corresponds to the first accommodation groove 11, and the fitting member 2 includes a second section 22 fitting with the first guide groove 13, wherein a length of the first section 21 is less than a depth of the first accommodation groove 11, such that when the fitting member 2 slides to the hollow body 1, a polygonal section of the first accommodation groove 11 is released.

The fitting member 2 includes a second accommodation groove 23 formed on the first section 21, and a diameter of the fitting member 2 is less than the first accommodation groove 11. The fitting member 2 includes a polygonal hole 24 formed on the second section 22 thereof and communicating with the second accommodation groove 23, and a peripheral trough 25 formed on an outer wall of the second section 22. The hollow body 1 further includes at least one fixing element 15 inserted through the first guide groove 13 so as to be fixed in the peripheral trough 25 and to limit a maximum sliding distance of the fitting member 2.

The first spring 4 is accommodated in the first guide groove 13, wherein a first end of the first spring 4 abuts against a stepped connection portion of the first guide groove 13 and the second guide groove 14, and a second end of the first spring 4 is biased against the second section 22 of the fitting member 2 so that the first section 21 flushes with an opening of the first accommodation groove 11.

The operation bar 3 includes a polygonal extension 31 corresponding to the polygonal hole 24, a peripheral rib 32 configured to abut against the second section 22 so as to limit a maximum moving distance of the operation bar 3.

A first end of the second spring 5 abuts against a bottom of the second guide groove 14, and a second end of the second spring 5 pushes the polygonal extension 31 of the operation bar 3 to extend out of the second accommodation groove 23.

Figure 3:
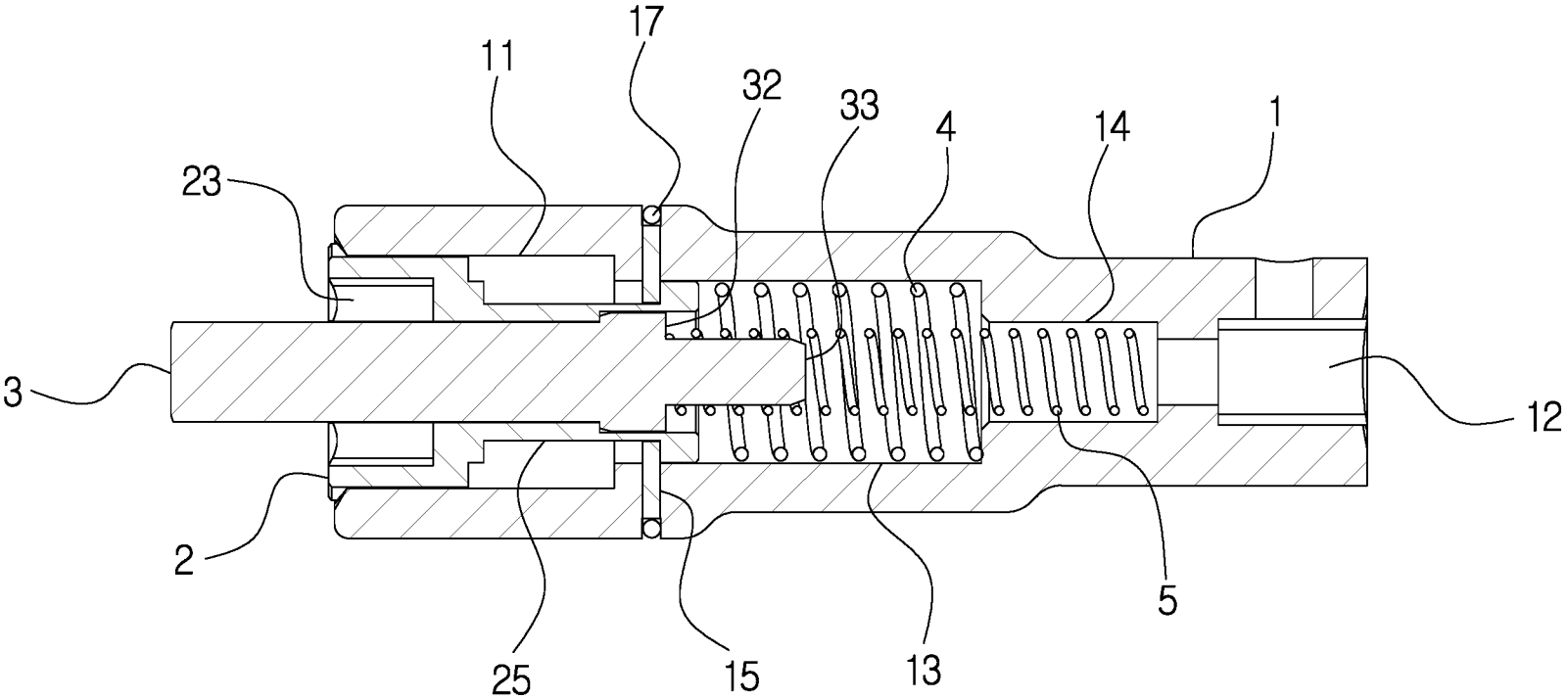
FIG. 3 is a cross sectional view showing the assembly of the socket structure according to the preferred embodiment of the present invention.
Figure 4:
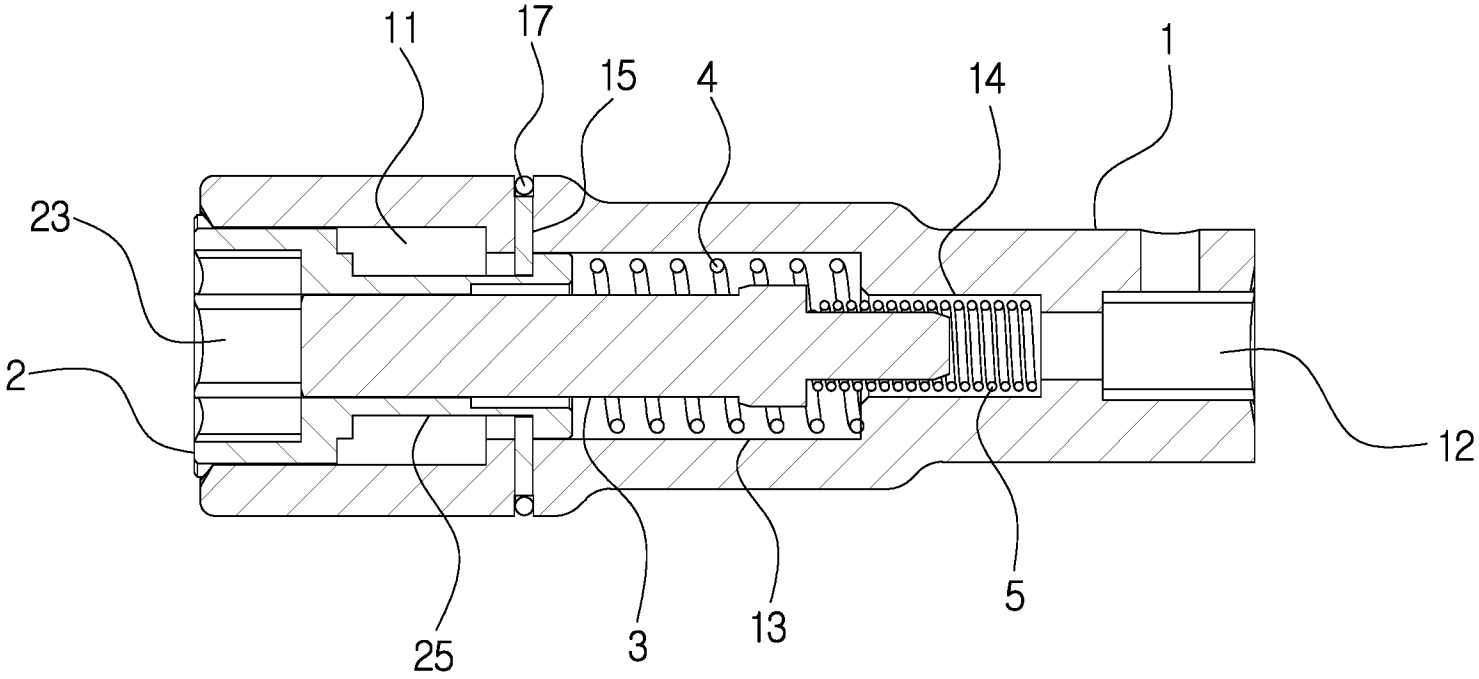
FIG. 4 is a cross sectional view showing the operation of the socket structure according to the preferred embodiment of the present invention.
Figure 5:
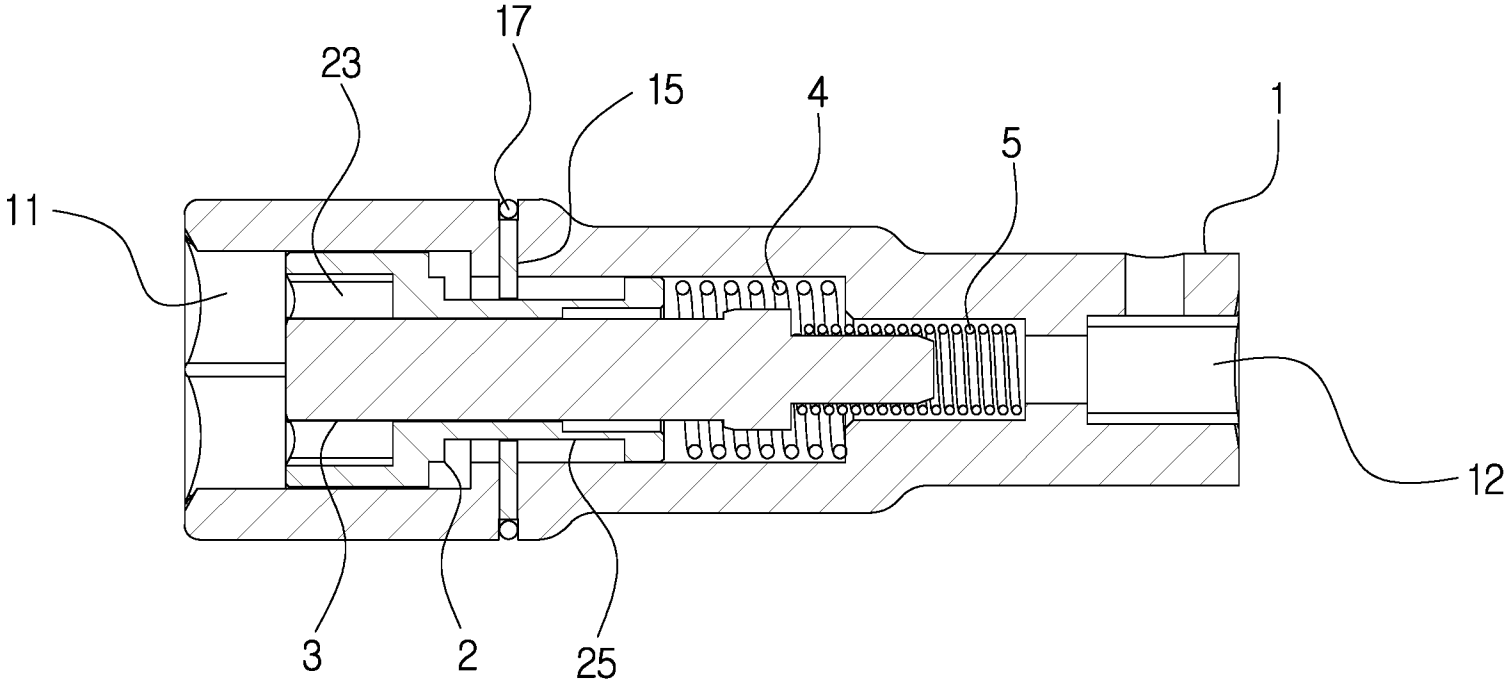
FIG. 5 is another cross sectional view showing the operation of the socket structure according to the preferred embodiment of the present invention.

When the operation bar 3 and the fitting member 2 are not pressed, the fitting member 2 is located on the opening of the first accommodation groove 11, and the polygonal extension 31 extends out of the second accommodation groove 23. As shown in FIG. 3, the polygonal extension 31 is a wrench corresponding to another driven element of the second accommodation groove 23, the operation bar 3 presses the second spring 5 so as to retract into the hollow body 1 so as to release the second accommodation groove 23 to drive another driven element, as shown in FIG. 4. When the polygonal extension 31 corresponds to the polygonal workpiece of the first accommodation groove 11, the fitting member 2 and the operation bar 3 press the first spring 4 and the second spring 5, and the fitting member 2 retracts into the hollow body 1 so as to release the first accommodation groove 11 to drive the polygonal driven element.

The hollow body 1 includes a surround trough 16 formed on an outer wall thereof, the at least one fixing element 15 is a bolt located on a bottom of the surround trough 16 and inserting into the first guide groove 13. The hollow body 1 includes a C-shaped ring 17 fitted into the surround trough 16 of the hollow body 1, such that the at least one fixing element 15 is fixed on a side of the hollow body 1 securely.

The first end of the second spring 5 pushes against the peripheral rib 32 of the operation bar 3, and the operation bar 3 includes a column 33 configured to fit with the second spring 5, such that the second spring 5 does not interfere the first spring 4 by using the column 33 as pressing.

The first accommodation groove 11 is pentagonal, the second accommodation groove 23 is hexagonal, and the polygonal extension 31 is hexagonal so as to correspond to driven elements of various shapes.

The socket structure corresponds to a variety of screws and nuts by way of the first accommodation groove and the second accommodation groove, and the operation bar is used as Allen wrench.

While various embodiments in accordance with the present invention have been shown and described, it is clear to those skilled in the art that further embodiments may be made without departing from the scope of the present invention.

What is claimed is:

1. A socket structure comprising: a hollow body, a fitting member, an operation bar, a first spring, and a second spring;

wherein the hollow body includes a first accommodation groove defined on a first end thereof and configured to accommodate a polygonal driven element, a connection groove formed on a second end of the hollow body and configured to connect with a wrench, a first guide groove defined in the hollow body adjacent to the first accommodation groove, and a second guide groove defined between and communicating with the connection groove and the first guide groove, wherein a diameter of the first guide groove is more than the second guide groove;

wherein the fitting member is movably housed in the first accommodation groove and the first guide groove, the fitting member includes a first section, an outer diameter of which corresponds to the first accommodation groove, and the fitting member includes a second section fitting with the first guide groove, wherein a length of the first section is less than a depth of the first accommodation groove;

wherein the fitting member includes a second accommodation groove formed on the first section, and a diameter of the fitting member is less than the first accommodation groove, the fitting member includes a polygonal hole formed on the second section thereof and communicating with the second accommodation groove, and a peripheral trough formed on an outer wall of the second section, the hollow body further includes at least one fixing element inserted through the first guide groove so as to be fixed in the peripheral trough and to limit a maximum sliding distance of the fitting member;

wherein the first spring is accommodated in the first guide groove, a first end of the first spring abuts against a stepped connection portion of the first guide groove and the second guide groove, and a second end of the first spring is biased against the second section of the fitting member so that the first section flushes with an opening of the first accommodation groove;

wherein the operation bar includes a polygonal extension corresponding to the polygonal hole, a peripheral rib configured to abut against the second section so as to limit a maximum moving distance of the operation bar; and wherein a first end of the second spring abuts against a bottom of the second guide groove, and a second end of the second spring pushes the polygonal extension of the operation bar to extend out of the second accommodation groove.

2. The socket structure as claimed in claim 1, wherein the hollow body includes a surround trough formed on an outer wall thereof, the at least one fixing element is located on a bottom of the surround trough and inserting into the first guide groove; the hollow body includes a C-shaped ring fitted into the surround trough of the hollow body.

3. The socket structure as claimed in claim 1, wherein the first end of the second spring pushes against the peripheral rib of the operation bar, and the operation bar includes a column configured to fit with the second spring.

4. The socket structure as claimed in claim 1, wherein the first accommodation groove is pentagonal, the second accommodation groove is hexagonal, and the polygonal extension is hexagonal.

* * * * *